US007154456B1

(12) United States Patent
Saito

(10) Patent No.: US 7,154,456 B1
(45) Date of Patent: Dec. 26, 2006

(54) ELECTROLUMINESCENCE DISPLAY APPARATUS

(75) Inventor: Yoshinori Saito, Konan (JP)

(73) Assignee: Sanyo Electric Co., Ltd. (JP)

( * ) Notice: Subject to any disclaimer, the term of this patent is extended or adjusted under 35 U.S.C. 154(b) by 0 days.

(21) Appl. No.: 09/645,850

(22) Filed: Aug. 24, 2000

(30) Foreign Application Priority Data

Aug. 26, 1999 (JP) ..... 11-240199

(51) Int. Cl.
*G09G 3/30* (2006.01)
*G09G 3/32* (2006.01)

(52) U.S. Cl. ..... 345/77; 345/83

(58) Field of Classification Search ..... 345/76, 345/77, 78, 72, 74.1, 75.2, 75.1, 54, 83
See application file for complete search history.

(56) References Cited

U.S. PATENT DOCUMENTS 3,909,788 A 9/1975 Kaelin et al. ..... 345/83
5,838,288 A * 11/1998 Lambert et al. ..... 313/495
5,844,531 A * 12/1998 Betsui ..... 315/169.3
5,898,415 A 4/1999 Hansen et al. ..... 345/74.1
5,949,393 A * 9/1999 Sakai et al. ..... 345/74.1
5,986,628 A * 11/1999 Tuenge et al. ..... 315/169.3
6,077,458 A * 6/2000 Shiiki et al. ..... 252/301.4 R
6,366,026 B1 * 4/2002 Saito et al. ..... 315/169.1
6,369,786 B1 * 4/2002 Suzuki ..... 345/77

FOREIGN PATENT DOCUMENTS

| | | |
|---|---|---|
| EP | 0 831 451 | 3/1998 |
| JP | 09274471 | 10/1997 |
| WO | 99/41788 | 8/1999 |

OTHER PUBLICATIONS

Kazuyuki Koga et al: "RGB Multi-Color LED Dot-Matrix Units and Their Applications to Large-Size Flat Displays" Optoelectronics Devices and Technologies, Mita Press, Tokyo, JP vol. 7, No. 2, Dec. 1, 1992, pp. 221-229.
European Search Report.

* cited by examiner

*Primary Examiner*—Richard Hjerpe
*Assistant Examiner*—Kevin M. Nguyen
(74) *Attorney, Agent, or Firm*—Cantor Colburn LLP

(57) ABSTRACT

When one row electrode has been selected with a selection signal, driving signals are supplied to column electrodes so as to cause electroluminescence elements at corresponding display pixels to emit light. The driving period for impressing the driving signals and emitting light from the corresponding display pixels is determined on the basis of the color of the display pixel that is to emit light. Thus, with a simple configuration, the brightness of each color can be made uniform without the use of pulse width modulation or the like.

14 Claims, 5 Drawing Sheets

ELECTROLUMINESCENCE DISPLAY APPARATUS

BACKGROUNG OF THE INVENTION

1. Field of the Invention

The present invention relates to a driving method for a passive matrix electroluminescence display apparatus comprising organic electroluminescence elements.

2. Description of the Related Art

In recent years, electroluminescence (referred to hereinafter as EL) display apparatuses using EL elements have attracted attention as display apparatuses to replace CRTs and LCDs, and the research and development into EL display apparatuses have also advanced.

FIG. 1 shows a cross-sectional structure of a display section of an ordinary organic EL display apparatus.

As shown in the figure, each organic EL element provided at each display pixel section has a laminated structure on a transparent glass substrate 1 in a sequence of an anode 2 formed from a transparent electrode, such as ITO, a hole transport layer 3 formed from MTDATA (4,4-bis(3-methylphenylphenylamino)biphenyl) and TPD (4,4,4-tris(3-methylphenylphenylamino)triphenylanine), an emitting layer 4 formed from $Bebq_2$ (bis(10-hydroxybenzo[h]quinolinato) beryllium complex) including a Quinacridone inductor, an electron transport layer 5 formed from $Bebq_2$, and a cathode 6 formed from a magnesium indium (MgIn) alloy.

Furthermore, in the organic EL element, holes injected from the anode and electrons injected from the cathode are recombined within the emitting layer to excite the organic molecules forming the emitting layer and generate excitons. In a process where excitons are radiated and deactivated, light is released from the emitting layer. The light is then discharged to emit light to the outside from the transparent anode via the transparent insulating substrate.

FIG. 2 shows a block diagram of a driving circuit of the organic EL display apparatus, and FIG. 3 shows a timing chart for driving the organic EL display apparatus.

As shown in FIG. 2, the organic EL display apparatus comprises a column driver 7, a row driver 8, and a display pixel section 12. Column electrodes col1, col2, col3, . . . , colm, which are arranged as stripes along the vertical direction of the columns in the same figure and which are the cathodes 6 of the organic EL elements connected to the column driver 7, and row electrodes row1, row2, row3, . . . , rown, which are arranged as stripes along the horizontal direction of the rows and which are the anodes 2 of the organic EL elements connected to the row driver 8, intersect each other, and display pixels PX11, PX12, . . . , PXnm at the respective intersections are arranged in a matrix configuration.

As shown in FIGS. 1 and 2, to the column driver 7 are supplied a transfer clock CLK, transfer data DATA, and latch pulses LS for one line of data, and to the row driver 8 is supplied a row driver clock VCLK.

Scanning signals are supplied in accordance with the row driver clock VCLK to the respective row electrodes row1, row2, row3, . . . , rown, which are cathodes on one side of the organic EL display elements. The scanning signals become a low level at every horizontal scanning period in sequence from row electrode row1 so that the respective row electrode row1, row2, row3, . . . , rown is selected. Furthermore, to the respective column electrodes col1, col2, col3, . . . , colm, which are anodes on the other side, is supplied the transfer data DATA by the latch pulses LS in accordance with the transfer clock CLK as transfer data, namely, driving signals.

In this manner, the respective display pixels PX11 to PXnm, which are provided at the respective intersections of the respective row electrodes row1, row2, row3, . . . , rown and the respective column electrodes col1, col2, col3, . . . , colm, emit light in colors corresponding to the luminescent materials of various colors provided at the display pixel section.

The display colors of the display pixels will be described for the case where display pixel PX12 furnishes a red color, display pixel PX23 furnishes a blue color, and the other display pixels PX11 to PX13, PX21, and PX31 to PX33 furnish a green color.

For example, as shown in FIG. 3, when a low level scanning signal ROW1 is supplied to row electrode row1, only row electrode row1 is selected for 1 H. Then, the transfer data DATA in accordance with the transfer clock CLK is written with the latch pulse LS to the respective column electrodes col1, col2, and col3. Namely, the driving signals COL1, COL2, and COL3 are supplied to the respective column electrodes col1, col2, and col3. In this case, the display pixels PX11 to PX13 that are connected to the row electrode row1 are all green so that each of the display pixels emits green light for the period of 1 H.

Next, the scanning signal ROW2 that is supplied to the row electrode row2 becomes a low level in accordance with the row driver clock VCLK so that the row electrode row2 is selected for 1 H. Then, the driving signals COL1, COL2, and COL3 are supplied to the respective column electrodes col1, col2, and col3, and the luminescent material of the various colors provided at the display pixels PX21 to PX23 at the respective intersections emit light. Namely, display pixel PX21 emits green light, display pixel PX22 emits red light, and display pixel PX23 emits blue light. At this time, the display pixels emit light only during the period when the row electrode is selected, namely, the period of 1 H.

Furthermore, for the case of row electrode row3 also, similar to the above-mentioned row electrodes row1 and row2, the scanning signal ROW3 that is supplied becomes a low level in accordance with the row driver clock VCLK so that the row electrode row3 is selected for 1 H, and the driving signals COL1, COL2, and COL3 are supplied to the respective column electrodes col1, col2, and col3 so that the luminescent materials provided at the display pixels PX31 to PX33 at the respective intersections emit light. Namely, the respective display pixels PX31 to PX33 emit light only during the period when the row electrode is selected, namely, the period of 1 H.

As described above, the respective row electrodes row1, row2, and row3 are each selected for a period of 1H. Namely, the respective display pixels PX11 to PX33 emit light in a color corresponding to the luminescent material of the respective color only for a period of 1H.

However, the luminescent materials of the respective colors provided at the respective display pixels PX11 to PX33 have different luminous efficiencies that depend on the material. Thus, when the display pixels of the various colors emit light for the same period, namely, for the period of 1 H, there is a shortcoming where the luminance of the colors is not uniform.

In order to correct for the luminance difference among the colors, it is possible to employ a pulse width modulation (PWM) system for the current value for each color to adjust the light emitting amount in accordance with the luminous efficiency of the luminescent material.

The PWM system and more particularly the structure of the column driver are described hereinafter with reference to FIG. 4.

The column driver 7 comprises a shift register 13 for inputting n-bit gradation data mDATA for each column according to a shift clock CL, a latch circuit 14 for latching the data that was input to the shift register 13 in accordance with the latch pulse, an n-bit counter 15 for representing the gradation levels, and m number of pulse width modulation circuits 16 for comparing the n-bit gradation data from the latch circuit 14 provided for each column and the n-bit counter value, then respectively outputting the column driving signals COL1, COL2, COL3, . . . , COLm having pulse widths proportional to the gradation data.

Namely, if n=3, for example, the count value of the n-bit counter 15 changes in a sequence of "0", "1", . . . , "7" during 1 H as shown in FIG. 5, and the driving signals COL1, COL2, COL3, COLm for the column electrodes all simultaneously begin output at a timing when the counter value becomes "1". The high level is maintained during the pulse width period in accordance with the gradation data for the respective pixel. Therefore, the display pixels in the same row emit light, and the light emitting period of each display pixel is controlled in accordance with the gradation data.

Although it is possible to correct for the luminance of each color by employing the PWM column driver having this sort of configuration, a shortcoming is that the circuit becomes complex. For example, the column driver cannot be easily fabricated into an IC device.

SUMMARY OF THE INVENTION

It is therefore an object of the present invention to provide an EL display apparatus without using a complex circuit configuration and in which is obtained a display having uniform luminance without creating a luminance difference among colors.

According to the present invention, the driving signal is supplied to each column electrode so as to cause the electroluminescence element of the corresponding display pixel to emit light when one row electrode has been selected by the selection signal. However, the driving period in which the driving signal is impressed so as to cause the corresponding display pixel to emit light is determined on the basis of the color of the display pixel that is to emit light. For example, the driving period is shortened (such as to a length of "1") for the electroluminescence element for emitting green light, which has a high luminous efficiency, set to a medium length (such as to a length of "2") for the electroluminescence element for emitting red light, which has a medium luminous efficiency, and lengthened (such as to a length of "4") for the electroluminescence element for emitting blue light, which has a poor luminous efficiency. Thus, the brightness of the colors can be made equal using a simple configuration, without using pulse width modulation or the like.

DETAILED DESCRIPTION OF THE PREFERRED EMBODIMENTS

A driving method for an EL display apparatus of the present invention is described hereinafter.

Figure 6:
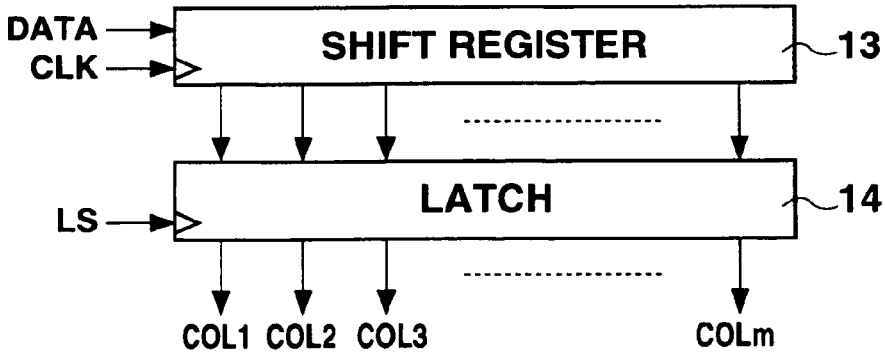
FIG. 6 is a block diagram of a column driver of the present invention.

FIG. 6 is a block diagram of a column driver.

The column driver comprises the shift register 13 for inputting the data DATA for each column according to the shift clock CLK and the latch circuit 14 for latching in accordance with the latch pulse the data DATA that was input by the shift register 13. The driving signals COL1, COL2, COL3, . . . , COLm are respectively output to the column electrodes col1, col2, col3, . . . , colm from the latch circuit 14.

Figure 1:
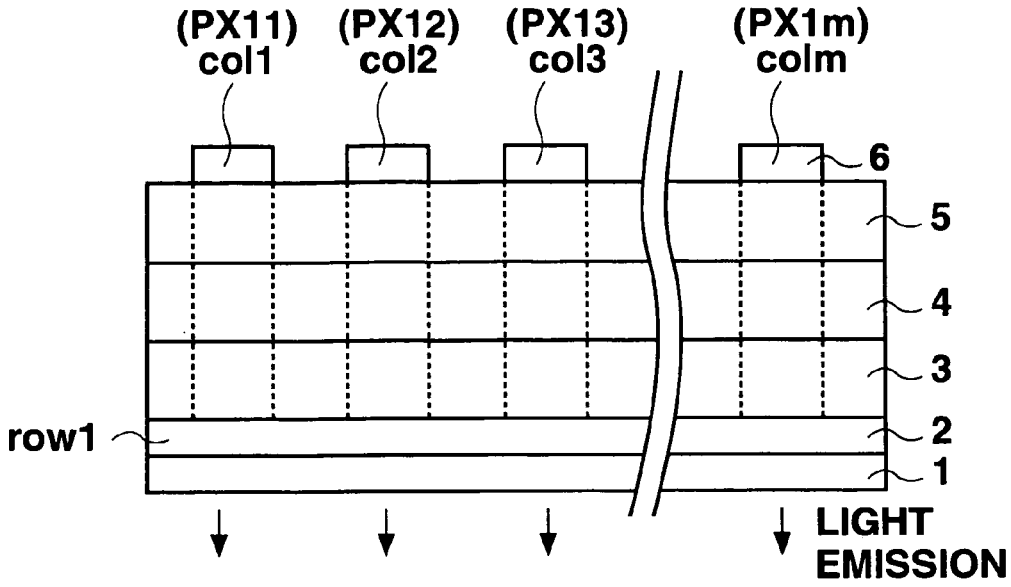
Fig. 1 PRIOR ART
FIG. 1 is a cross-sectional view of an ordinary EL display apparatus.
Figure 2:
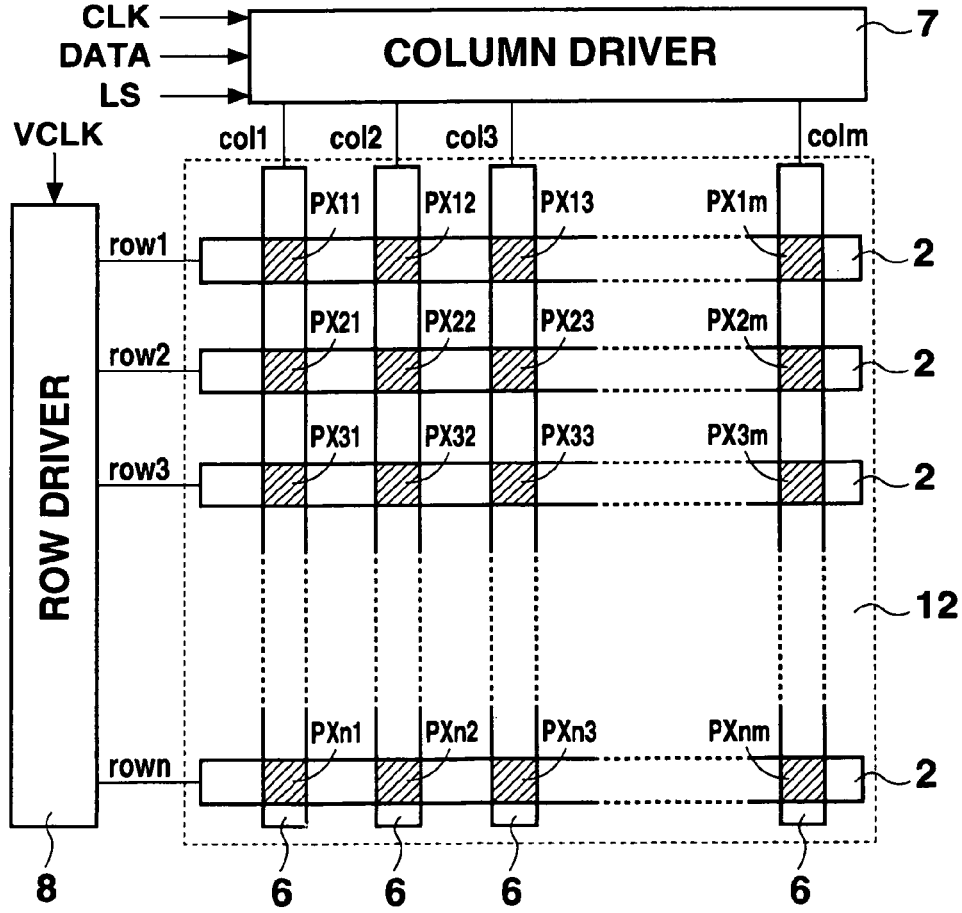
Fig. 2 PRIOR ART
FIG. 2 is a block diagram of a driving circuit of the EL display apparatus.
Figure 3:
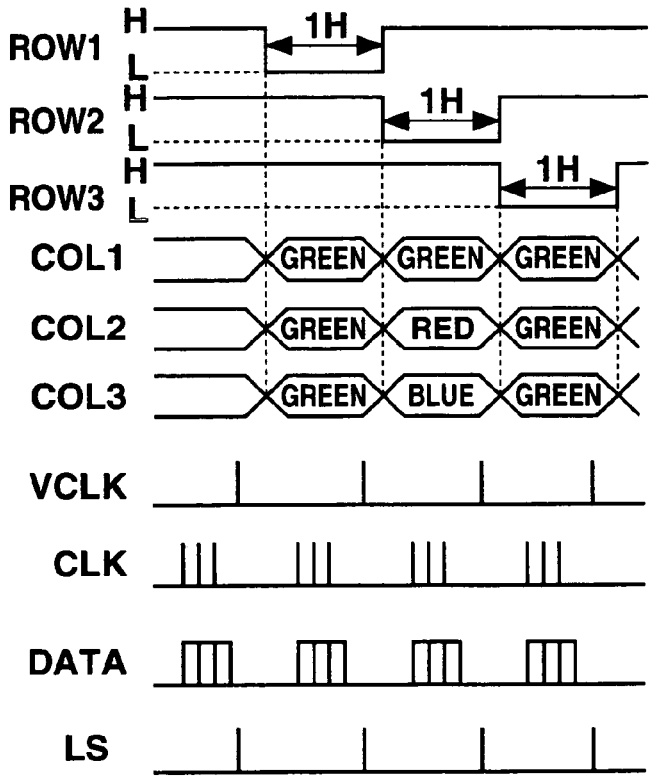
Fig. 3 PRIOR ART
FIG. 3 is a timing chart for the EL display apparatus of the prior art.
Figure 4:
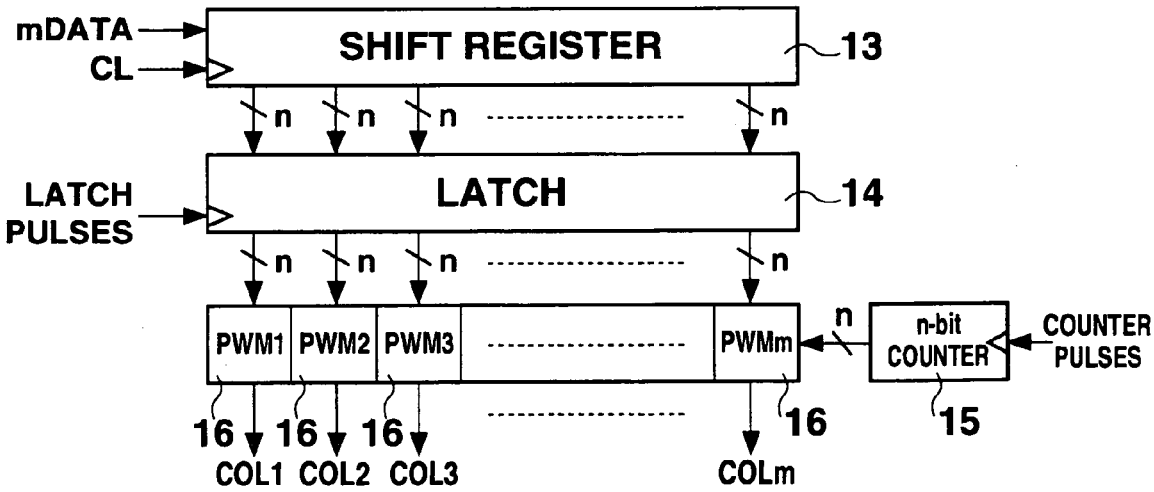
Fig. 4 PRIOR ART
FIG. 4 is a block diagram of a column driver of the prior art.
Figure 5:
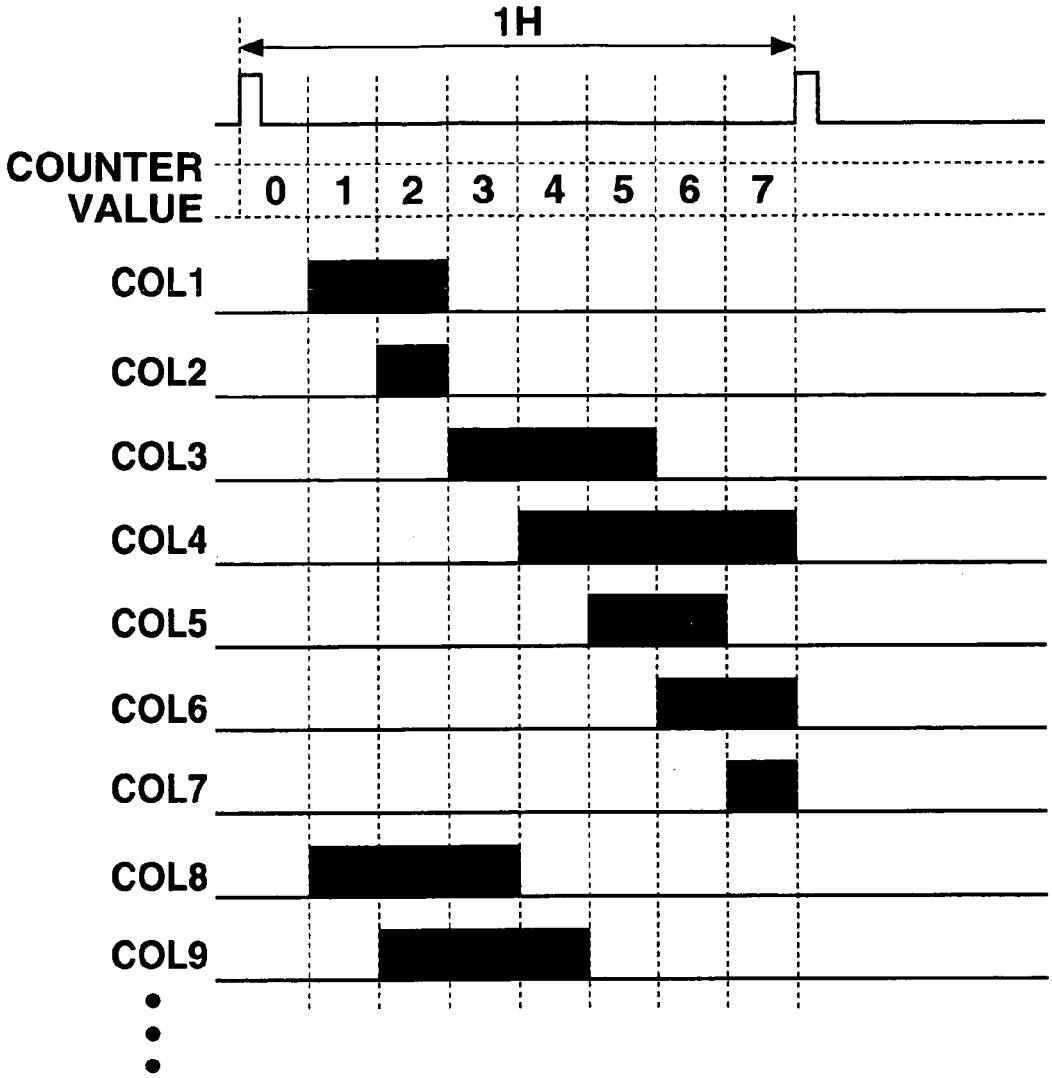
Fig. 5 PRIOR ART
FIG. 5 is a timing chart of conventional pulses.

Compared to the column driver of the prior art shown in FIG. 4, the organic EL display apparatus of the present invention obviates the pulse width modulation circuits. Therefore, compared to the extreme complexity as in the column driver of the organic EL display apparatus of the prior art, the column driver of the organic EL display apparatus of the present invention can be designed to have an extremely simple configuration. Thus, it is possible to fabricate the column driver into an IC device.

Figure 7:
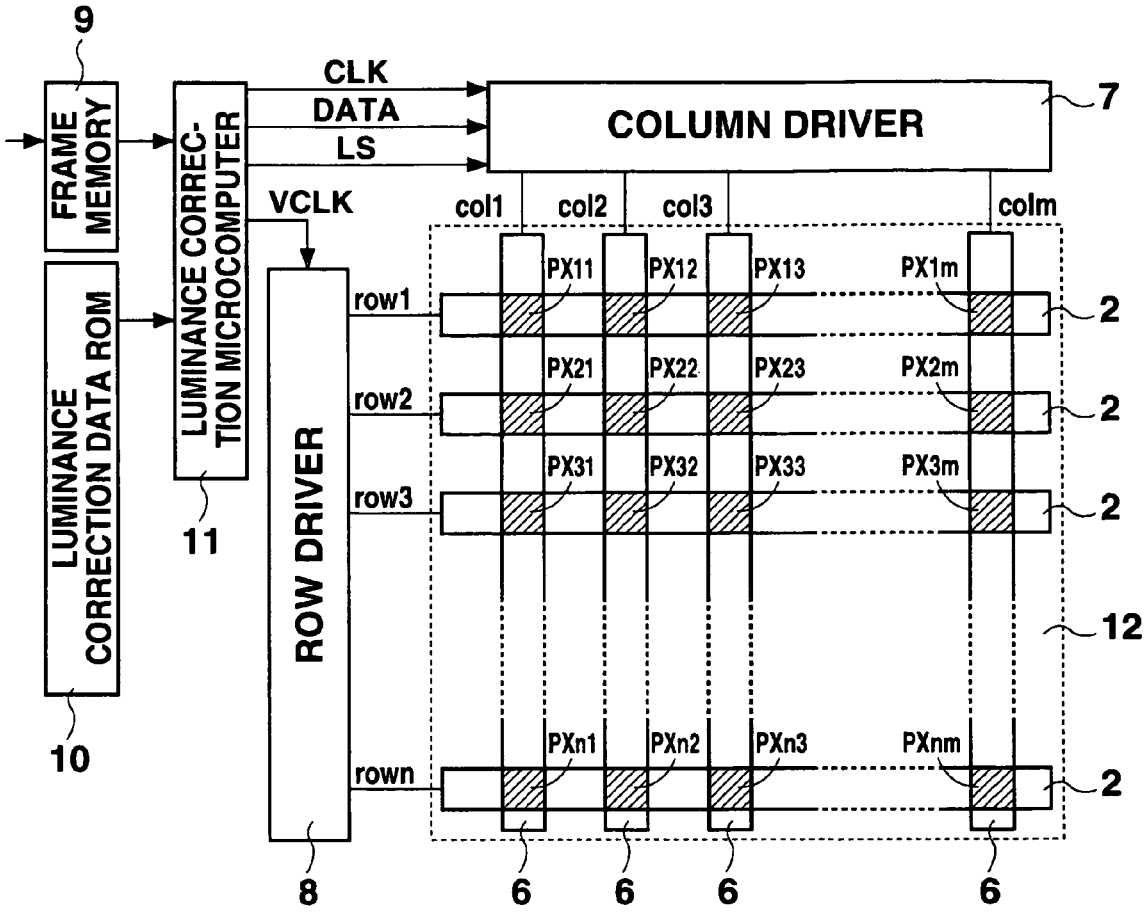
FIG. 7 is a block diagram of a driving circuit representing an embodiment of the present invention.

As shown in FIG. 7, the organic EL display apparatus comprises the column driver 7 shown in FIG. 6, the row driver 8, and the display pixel section 12, and further comprises a frame memory 9, a luminance correction data ROM 10, and a luminance correction microcomputer 11.

The data to be displayed on the organic EL display apparatus is stored from an external source into the frame memory 9. Information on the color and position arrangement on the organic EL display panel is stored beforehand in the luminance correction data ROM 10. Namely, in FIG. 8, for example, in the case where the display pixel PX21 is green and the display pixel PX22 is red, that information is stored into the luminance correction data ROM 10.

When performing luminance correction, the luminance correction control microcomputer 11 reads out the data stored in the frame memory 9 and the information in the luminance correction data ROM 10, and outputs picture data, namely, driving signals, to the column driver 7.

Figure 8:
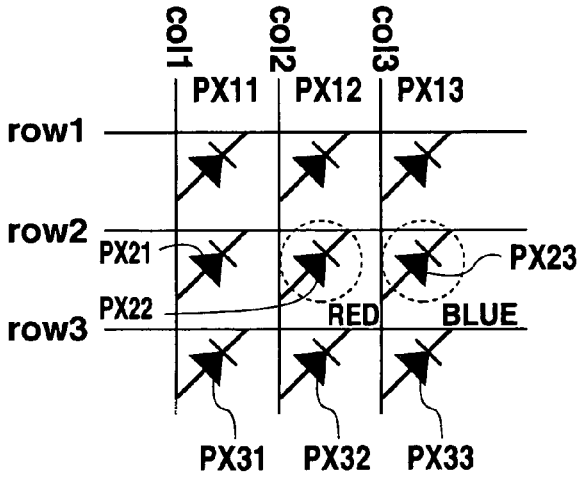
FIG. 8 an equivalent circuit of part of the EL display apparatus representing an embodiment of the present invention.

A description will be given with regard to the display pixels PX11 to PX13, PX21 to PX23, and PX31 to PX33 configured, as shown in FIG. 8, from both the column electrodes col1 to col3 and the row electrodes row1 to row3.

Figure 9:
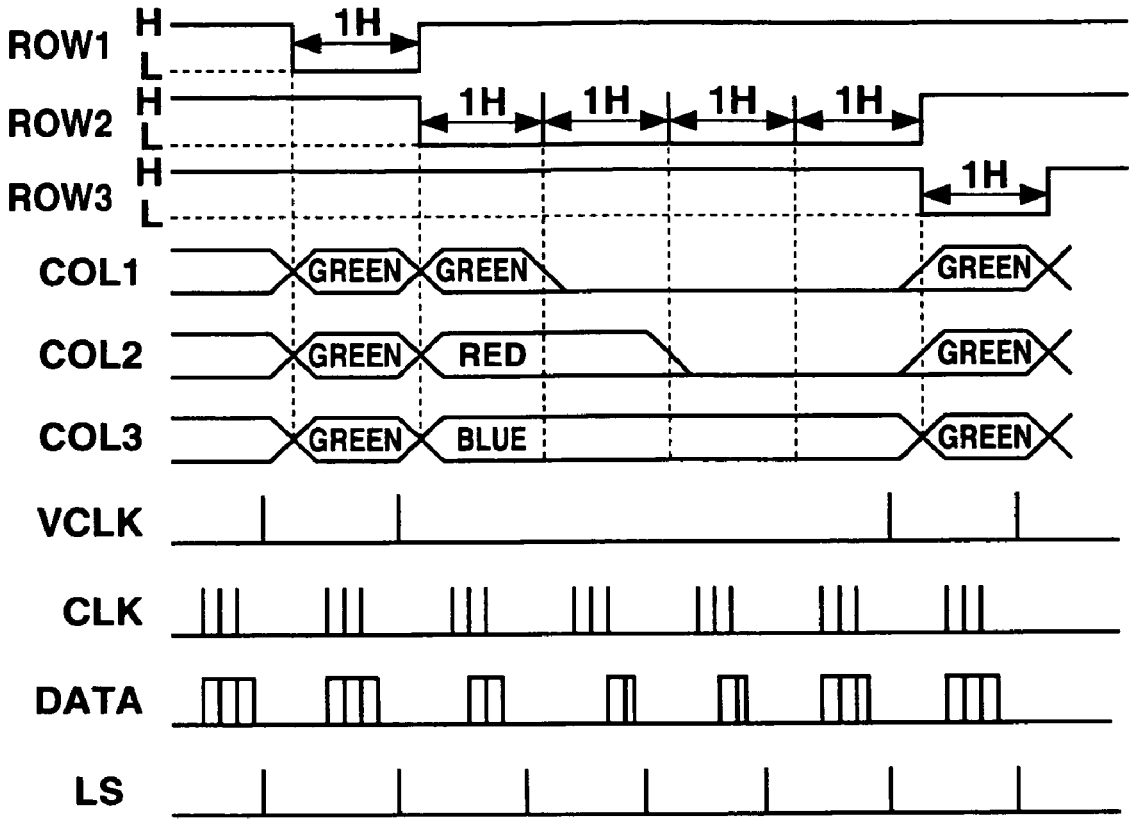
FIG. 9 is a timing chart representing an embodiment of the present invention.

FIG. 9 shows a timing chart for driving of the organic EL display apparatus, which is an embodiment of a driving method for the EL display apparatus of the present invention.

FIG. 8 shows the display pixels PX11 to PX13, PX21 to PX23, and PX31 to PX33 configured from both the column electrodes col1 to col3 and the row electrodes row1 to row3.

A case will be described where the display pixel PX22 provides a red color, the display pixel PX23 provides a blue color, and the other display pixels PX11 to PX13, PX21, and PX31 to PX33 provide a green color.

In this case, the luminous efficiency of the luminescent materials of the various colors is highest for green, medium for red, and lowest for blue, and the case will be described where the ratio of the luminous efficiencies of the various colors based on the luminous efficiency of the green luminescent material is green:red:blue=1:1/2:1/4.

The row electrodes row1, row2, and row3 are selected in sequence by row from row1 to row3. Among the row electrodes row1, row2, and row3, the scanning signal only for the selected row becomes a low level during one horizontal scanning period (1 H), and the scanning signals for the other rows become a high level. Namely, the row electrode row1 is selected when the signal ROW1 that is supplied to the row electrode row1 becomes a low level.

First, the row electrode row1 will be described.

When the row electrode row1 becomes a low level for a period of 1 H and is selected, a green light is emitted at the high level of column signal COL1 of the column electrode col1 since all the display pixels PX11 to PX13 connected to the row electrode row1 are green.

Next, the row electrode row2 becomes a low level at a timing when the row electrode row1 becomes a high level. At this time, as shown in FIG. 8, a red pixel with a luminous efficiency ratio of 1/2 and a blue pixel with a luminous efficiency ratio of 1/4 both with respect to green are provided in the row electrode row2. The selection time for the row electrode row2 is lengthened for the amount the luminous efficiency is low. Namely, the blue color is selected for a period four times that of the green color, or a period of 4 H.

Described next is the period during which the driving signals are impressed to the column electrodes col1 to col3 in the period of 4 H when the row electrode row2 has been selected.

Since a green color is provided at the display pixel PX21, which is connected to the column electrode col1, a driving signal is supplied only for a period of 1 H to the column electrode coil so that the display pixel PX21 emits green light.

Furthermore, since a red color is provided at the display pixel PX22, which is connected to the column electrode col2, a driving signal is supplied for a period of 2 H to the column electrode col2 so that the display pixel PX22 emits red light.

Finally, since a blue color is provided at the display pixel PX23, which is connected to the column electrode col3, a driving signal is supplied for a period of 4 H to the column electrode col2 so that the display pixel PX23 emits blue light.

Namely, during the first period of 1 H after the row electrode row2 becomes a low level, the driving signals are supplied to the column electrodes coil, col2, and col3 so that the display pixels PX21, PX22, and PX23 respectively emit green, red, and blue light. During the next period of 1 H (second H period), the driving signals are supplied only to the column electrodes col2 and col3 so that the display pixels PX22 and PX23 respectively emit red and blue light. During the next two periods of 1 H (third and fourth H periods), the driving signal is supplied only to the column electrode col3 so that only the display pixel PX23 emits blue light.

In other words, the row electrode row2 is selected four consecutive times (4 H), and during those four times, the green display pixel PX21 emits light for one time (1 H), the red display pixel PX22 emits light for two times (2 H), and the blue display pixel PX23 emits light for four times (4 H).

This is made possible by controlling the signals to be supplied by the frame memory 9, the luminance correction ROM 10, and the luminance correction microcomputer 11.

Namely, in the second H period, the luminance correction control microcomputer 11 reads out various types of information from the frame memory 9 and the luminance correction data ROM 10 in which is stored beforehand information that the display pixel PX22 has a red luminescent material with a luminous efficiency lower than that of the green luminescent material provided at the display pixel PX21, and corresponding to that information, the information with part (green color) of the image data deleted is transferred to the column driver so as to cause the red and blue lights to be emitted.

Similarly, in the third H and fourth H periods, on the basis of the information stored beforehand from the luminance correction data ROM, information with the green and red colors deleted is transferred to the column driver so as to cause only the blue light to be emitted.

In this manner, it is possible to equalize the luminance of the colors by setting the light emitting period Tg of the green display pixel provided with green luminescent material having the highest luminous efficiency, the light emitting period Tr of the red display pixel provided with red luminescent material having the next highest luminous efficiency, and the light emitting period Tb of the blue display pixel provided with blue luminescent material having the lowest luminous efficiency to Tg:Tr:Tb=1:2:4, which is proportional to the luminous efficiency ratio (green:red:blue=1:1/2:1/4) of the luminescent material for the respective colors. Thus, the organic EL display apparatus yields a uniform display without irregularities.

The above-mentioned embodiment exemplifies a case where the luminous efficiencies of the luminescent materials for the colors of green, red, and blue have the ratio of 1:1/2:1/4. However, the present invention is not limited to this case. In proportion to the luminous efficiency ratio of the various colors, the period for selecting the row electrode that is connected to the display pixel provided with luminescent material having the lowest luminous efficiency may be lengthened, and the period for supplying the driving signal to the column electrode connected to that pixel may be set so as to be the longest for the display pixel of the luminescent material having the lowest luminous efficiency.

Furthermore, the present embodiment showed a case where the luminescent materials of the display pixels were for green, red, and blue. However, the application concerned is not limited to this case. For example, in addition to green, red, and blue, the present invention is also applicable to a case using luminescent materials for yellow and white to yield the same effect. In this case an order of the luminescent efficiency is green, yellow, white, red, blue, however this order may be changed in accordance with luminescent materials.

Furthermore, in the above-mentioned embodiment, a case was described for three colors of luminescent materials for the display pixels. However, the number of colors is not limited to three and any number of colors may be used. For example, if two colors are selected, it is necessary to select the number of selection times for the row electrode and the number of times for supplying the driving signal to the column electrode in proportion to the ratio of the luminous efficiencies of their luminescent materials.

Furthermore, the selection time for the row electrode may be fixed and only the driving signal for the column electrode may be varied according to color.

Furthermore, the number of row electrodes and column electrodes is not limited and can be set in accordance with such requirements as resolution and display area.

It should be noted that the luminous efficiency ratios of the luminescent materials in the present invention need not necessarily be integer values. In the event a ratio is not an integer value, luminance correction can still be performed when compared to the prior art even if an approximate integer is selected.

According to the EL display apparatus of the present invention, an EL display apparatus can be obtained with a uniform luminance of the display pixels provided with luminescent materials of various colors having different luminous efficiencies.

While there has been described what are at present considered to be preferred embodiments of the invention, it will be understood that various modifications may be made thereto, and it is intended that the appended claims cover all such modifications as fall within the true spirit and scope of the invention.

What is claimed is:

1. An electroluminescence display apparatus in which display pixels are respectively formed at intersections of a plurality of row electrodes for supplying scanning signals and a plurality of column electrodes for supplying driving signals, and electroluminescence elements are respectively disposed having an emitting layer, formed from luminescent material for emitting light of a predetermined color, between said column electrodes and row electrodes of said display pixels, said electroluminescence display apparatus comprising:

a row electrode driving circuit capable of sequentially selecting said row electrodes by supplying a selection signal in sequence by row to each row electrode of said plurality of row electrodes;

a selected period of each row electrode of said plurality of row electrodes is determined in accordance with a color or colors of said electroluminescence elements connected to said plurality of row electrodes, wherein said selected period is not divided over said plurality of row electrodes;

a column electrode driving circuit capable of supplying a driving signal to each column electrode when one of said row electrodes has been selected by said selection signal and causing said electroluminescence element of corresponding display pixel to emit light, said one of said row electrodes is selected for said selected period based on a luminous efficiency ratio of luminescent materials at said row electrode; and a driving period capable of impressing said driving signal by said column electrode driving circuit and causing said corresponding display pixel to emit light based on color of said display pixel that is to emit light.

2. An electroluminescence display apparatus according to claim 1 wherein the lower the luminous efficiency of luminescent material of each color, the longer said driving period is set.

3. An electroluminescence display apparatus according to claim 2 wherein said driving period is set on the basis of a ratio of luminous efficiency of each luminescent material.

4. An electroluminescence display apparatus according to claim 1 wherein a selection period for impressing the selection signal by said row electrode driving circuit and selecting one row electrode is determined on the basis of the longest period among driving periods of a plurality of driving signals supplied to a plurality of column electrodes when the row electrode is selected.

5. An electroluminescence display apparatus according to claim 4 wherein there are a plurality of types of luminescent materials for said electroluminescence element, said electroluminescence element comprises one of the luminescent materials and emits light of one color.

6. An electroluminescence display apparatus according to claim 5 wherein colors of light emitted are five colors of green, yellow, white, red, and blue.

7. An electroluminescence display apparatus according to claim 5 wherein colors of light emitted are three colors of green, red, and blue; green has the best luminous efficiency, red has the next best luminous efficiency, and blue has the worst luminous efficiency.

8. A driving method for an electroluminescence display apparatus in which display pixels are respectively formed at intersections of a plurality of row electrodes for supplying scanning signals and a plurality of column electrodes for supplying driving signals, and electroluminescence elements are respectively disposed having an emitting layer, formed from luminescent material for emitting light of a predetermined color, between said column electrodes and row electrodes of said display pixels, said method comprising:

supplying a selection signal in sequence by row to each row electrode of said plurality of row electrodes;

determining a selected period of each row electrode of said plurality of row electrodes in accordance with a color or colors of said electroluminescence elements connected to said plurality of row electrodes, wherein said selected period is not divided over plurality of row electrodes;

supplying a driving signal to each column electrode when one of said row electrodes has been selected by said selection signal and said electroluminescence element of corresponding display pixel is caused to emit light, said one of said row electrodes is selected for said selected period based on a luminous efficiency ratio of luminescent materials at said row electrode; and impressing said driving signal and causing said corresponding display pixel to emit light based on color of said display pixel that is to emit light for a driving period.

9. A driving method according to claim 8 wherein the lower the luminous efficiency of luminescent material of each color, the longer said driving period is set.

10. A driving method according to claim 8 wherein said driving period is set on the basis of a ratio of luminous efficiency of each luminescent material.

11. A driving method according to claim 8 wherein the selection period for impressing said selection signal and selecting one row electrode is determined on the basis of the longest period among driving periods of a plurality of driving signals supplied to said plurality of column electrodes when the row electrode is selected.

12. An electroluminescence display apparatus according to claim 1 wherein said column electrode driving circuit is capable of being fabricated into an IC device.

13. An electroluminescence display apparatus according to claim 1 wherein said electroluminescence elements are organic electroluminescence elements.

14. A driving method according to claim 8 wherein said electroluminescence elements are organic electroluminescence elements.

* * * * *